United States Patent [19]

Brabant

[11] Patent Number: 4,957,284

[45] Date of Patent: Sep. 18, 1990

[54] APPARATUS AND METHOD FOR CONVERTING SHEET FOLDER TO BOOKLET MAKER

[75] Inventor: Yvan E. Brabant, Boca Raton, Fla.

[73] Assignee: Profold, Inc., Sebastian, Fla.

[21] Appl. No.: 239,983

[22] Filed: Sep. 2, 1988

[51] Int. Cl.[5] ..... B41L 43/12

[52] U.S. Cl. ..... 270/37; 270/45

[58] Field of Search ..... 270/32, 37, 38, 45, 270/53

[56] References Cited

U.S. PATENT DOCUMENTS

| | | | |
|---|---|---|---|
| 3,554,531 | 1/1971 | Heigl | 270/53 |
| 4,509,732 | 4/1985 | Kanno | 270/37 |
| 4,647,029 | 3/1987 | Ohmori | 270/45 |

FOREIGN PATENT DOCUMENTS

| | | | |
|---|---|---|---|
| 38942 | 11/1981 | European Pat. Off. | 270/37 |

OTHER PUBLICATIONS

Brochure of Profold, Inc. disclosing paper folders 9/88.

*Primary Examiner*—Robert E. Garrett
*Assistant Examiner*—Therese M. Newholm
*Attorney, Agent, or Firm*—Oltman and Flynn

[57] ABSTRACT

A sheet folder is convertible to a booklet maker by mounting a stapling and sheet guide unit at the inlet side of the folder. The stapling and sheet guide unit has a pair of laterally aligned staplers above a sheet guide which includes holders for engaging the stack of sheets along their opposite side edges and a retractable front stop engaging the leading edge of the stack of sheets to be stapled. A vibratory jogger on one of the holders aligns the edges of the sheets in the stack. After the stack of sheets is stapled, the front stop is retracted and a kicker plate strikes the stapled set of sheets from below, causing the stapled set of sheets to slide down into the folder. The folder has rollers which advance the leading edge of the stapled set of sheets against a stop and then continue to pull the stapled set of sheets, causing its stapled centerline to fold into a fold gap between rollers. The size of this fold gap is selectively adjustable.

19 Claims, 8 Drawing Sheets

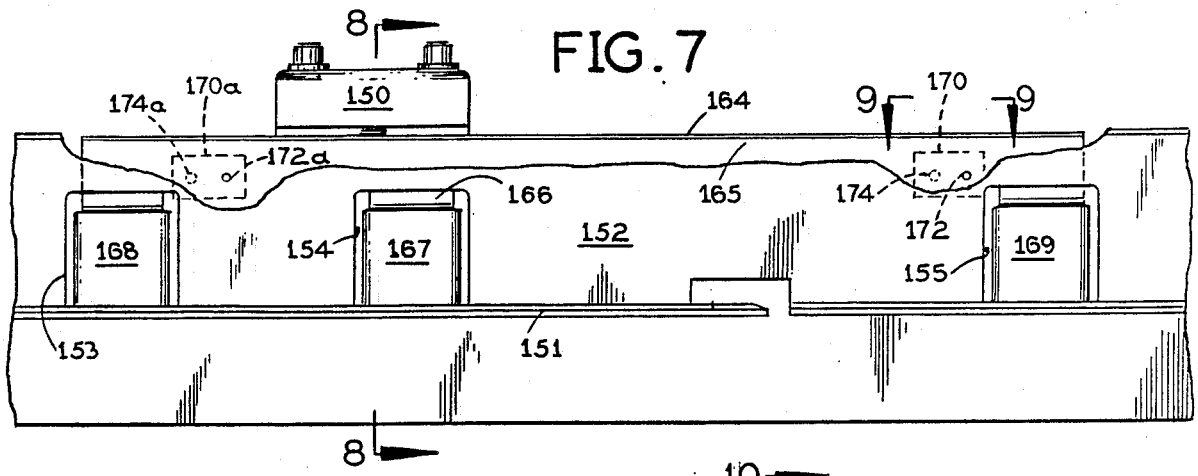
FIG. 7
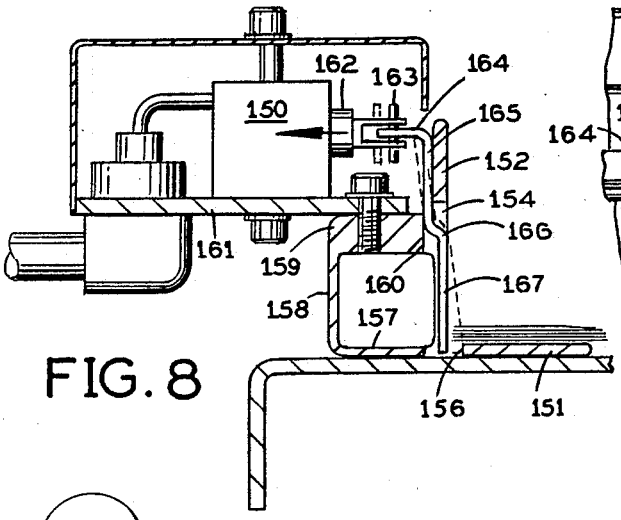
FIG. 8
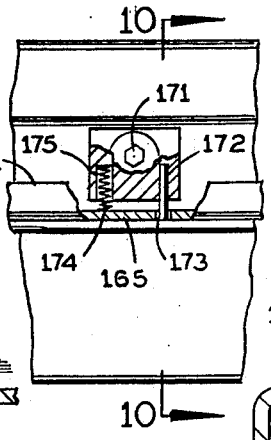
FIG. 9
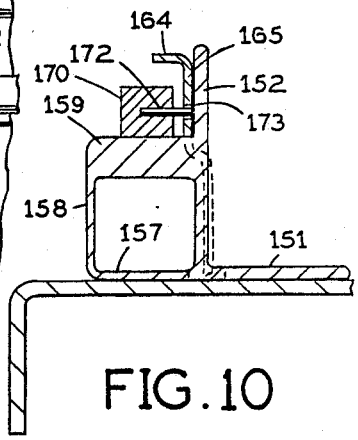
FIG. 10
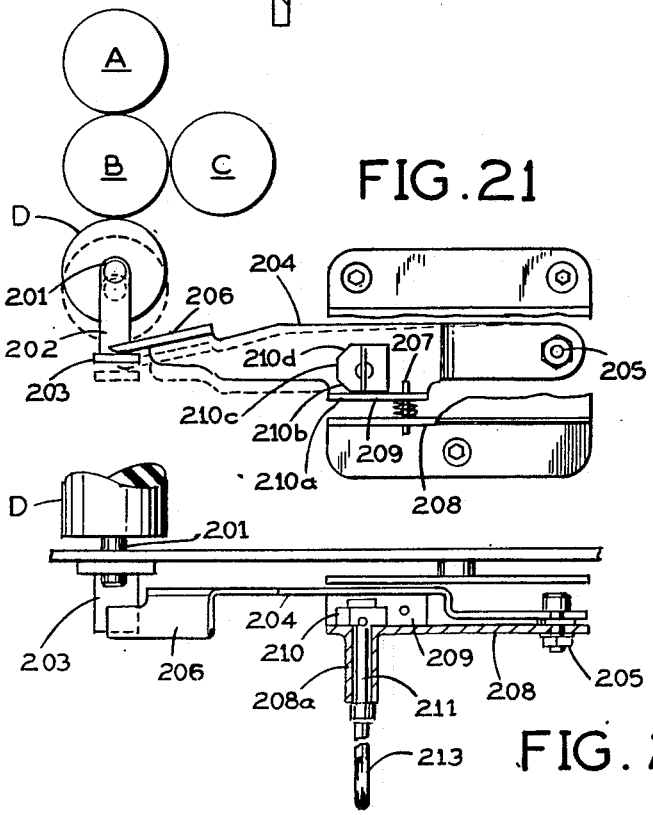
FIG. 21
FIG. 22
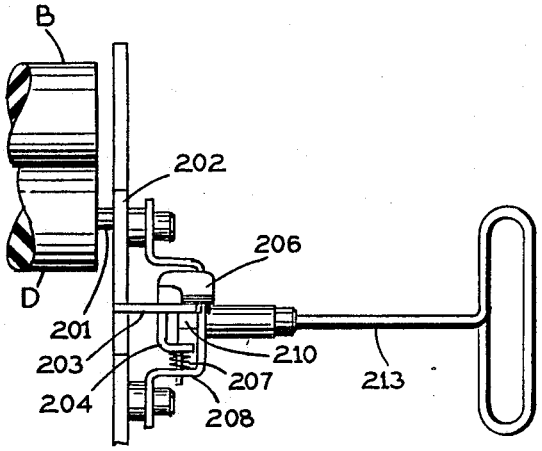
FIG. 23

FIG. 15
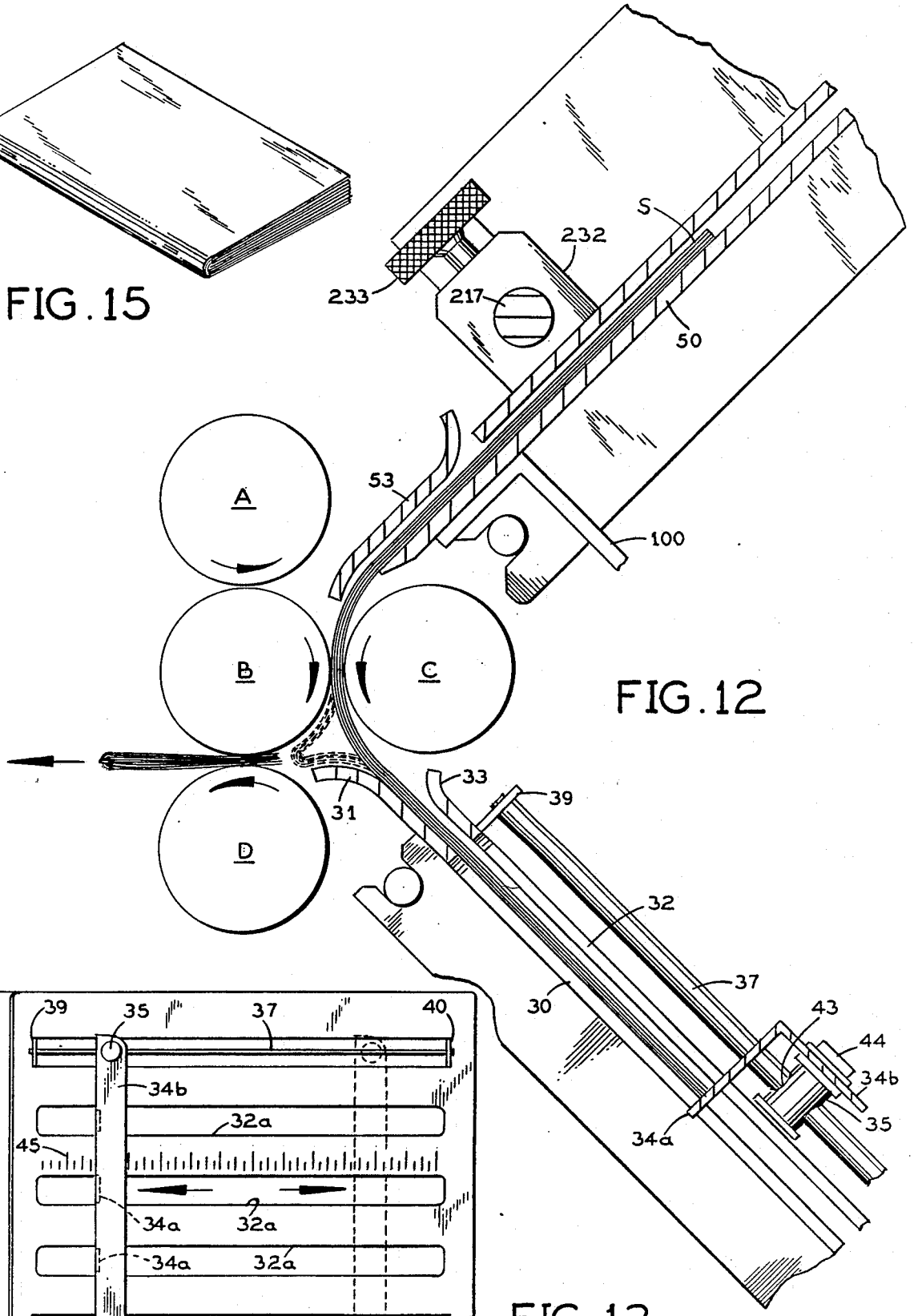
FIG. 12
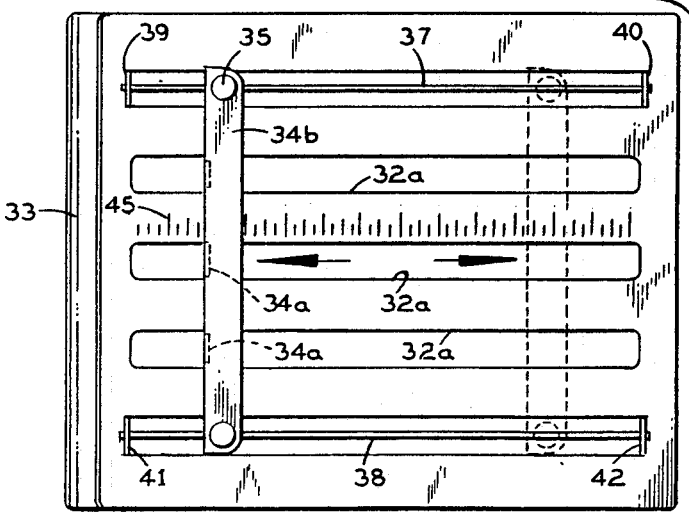
FIG. 13

APPARATUS AND METHOD FOR CONVERTING SHEET FOLDER TO BOOKLET MAKER

SUMMARY OF THE INVENTION

This invention relates to an apparatus and a method for converting a known type of paper folder to a booklet maker capable of producing booklets at a relatively high speed.

"Stand alone" (self-contained) booklet makers are in use which have stapling heads for stapling together a stack of sheets along a centerline and a folder with a mechanically actuated knife blade which forces the stapled sheets (stapled centerline first) between two spring-loaded rubber rollers to form a booklet with its folded spine at the stapled centerline of the original stack of sheets.

The present invention has a stapling and guide unit for attachment to a known type of folder different from the knife blade-type folders of the prior art stand-alone booklet makers. The present stapling and guide unit is attachable to this folder where its top fold plate would be located if the folder were operated in the conventional way as a single-sheet folder, in which this top fold plate is the top of a feed table.

In the preferred embodiment of the present invention, the stapling and guide unit has a pair of laterally adjustable, motor-powered staplers, a guide arrangement behind the staplers for receiving a stack of sheets that are to be stapled to provide the pages of a booklet, a retractable front stop located in front of the staplers for engagement by the leading edge of the stack of sheets and adjustable toward and away from the staplers in accordance with the sheet size, a solenoid-operated sheet jogger behind and in front of the staplers at one side for jogging the stack of sheets into close registration along the edges, and a kicker blade for insuring the release of the stapled set of sheets in timed relation with each stapling operation and the retraction of the front stop from engagement with the leading edge of the just-stapled set of sheets. The folder is modified by the addition of a roller gap adjustment arrangement to accommodate various booklet thicknesses.

A principal object of this invention is to provide a novel apparatus for attachment to a sheet folder to convert it to a booklet maker.

Another object of this invention is to provide a novel method of converting a paper folder to a booklet maker.

Further objects and advantages of this invention will be apparent from the following detailed description of a presently preferred embodiment which is illustrated schematically in the accompanying drawings.

DESCRIPTION OF THE DRAWINGS

FIG. 7 is a fragmentary vertical longitudinal section taken along the line 7—7 in FIG. 1 where the sheet jogger is located;

FIG. 8 is a fragmentary vertical cross-section taken along the line 8—8 in FIG. 7 showing part of the jogger;

FIG. 9 is a fragmentary plan view, with parts broken away, viewed from the line 9—9 in FIG. 7;

FIG. 10 is a fragmentary vertical cross-section taken along the line 10—10 in FIG. 9;

FIG. 12 is an enlarged fragmentary longitudinal sectional view of part of the folding mechanism;

FIG. 13 is a plan view of the adjustable lower limit stop in this folding mechanism;

FIG. 15 is a top perspective view showing a completed, folded booklet;

FIG. 21 is a fragmentary elevational view of the gap adjusting arrangement in the folding mechanism;

FIG. 22 is a view of this gap adjusting mechanism, partly a top plan view and partly in section; and FIG. 23 is an end elevation taken from the left end of FIG. 21.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figures 4, 14:
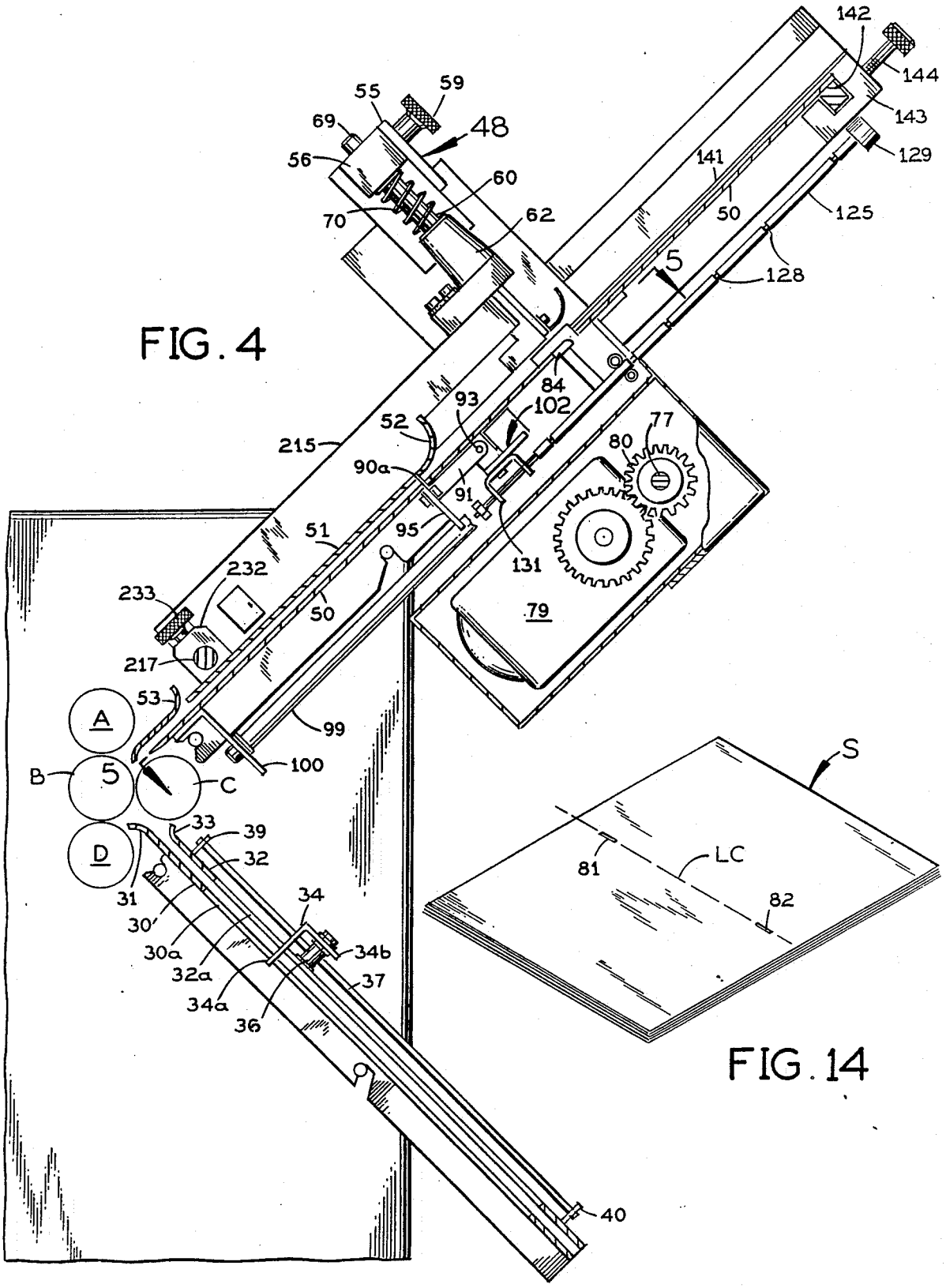
FIG. 4 is a vertical longitudinal section taken along the line 4—4 in FIG. 1.
FIG. 14 is a top perspective view showing a set of superimposed sheets stapled at the center and ready to be folded along the staple line into a booklet.

Part of the complete booklet maker in accordance with the present invention is a known folding mechanism as shown in the lower part of FIG. 4. This folding mechanism has four rollers A, B, C and D. Roller A is directly above roller B and drives it by virtue of the frictional rolling engagement between them. Roller B is in front of roller C at the same horizontal level and defines with it a nip through which a set of superimposed, stapled sheets of paper S passes down. Roller D is below roller B and defines with it a horizontal fold gap in which the set of stapled sheets of paper is folded along the staples. Roller D is spring-biased upward to normally engage roller B from below.

The folding mechanism has a lower plate 30 extending downward and rearward from the fold gap between rollers B and D at an angle of about 45 degrees to the vertical and on the same side of rollers A, B and D as roller C. At its upper end, plate 30 presents a convex top lip 31 which curves toward the fold gap between rollers B and D. An upper plate 32 extends parallel to lower plate 30 and defines with it a recess for receiving the set S of stapled sheets of paper with a sufficiently loose fit that the set can slide easily across the upper face 30' of lower plate 30 (which faces toward the upper plate). Upper plate 32 has a convex lip 33 at its upper end which curves up away from lower plate 30 to assure the entry of the set of stapled sheets between the two plates with no substantial likelihood of jamming.

A stop member 34 of right-angled cross-section presents several aligned, laterally spaced, front legs **34*a* (FIGS. 12 and 13) which extend perpendicularly between plates 32 and 30 for engagement by the leading edge of the set of stapled sheets. As shown in FIG. 13, the stop member has three such legs 34*a* extending down through longitudinal openings 32*a* in upper plate 32 and aligned longitudinal openings 30*a* (FIG. 4) in lower plate 30. Legs 34*a* extend down from a flat top segment 34*b* (FIG. 12) of the stop member which is spaced above the upper plate 32** and extends parallel to it.

At its opposite ends the top segment **34*b* of stop member 34 is attached to hollow support posts 35 and 36 which are slidably adjustable along respective guide rods 37 and 38 which extend above and parallel to upper plate 32. Rod 37 is supported at its opposite ends by short plates 39 and 40 (FIGS. 12 and 13) which are rigidly attached to upper plate 32 and extend perpendicular to it. Rod 38 is supported at its opposite ends by short plates 41 and 42 which extend perpendicularly from upper plate 32. Post 35 has a cross-opening at 43 in FIG. 12 which snugly but slidably passes the corresponding guide rod 37. Above this rod, post 35 is internally screw-threaded and there it threadedly receives a clamping screw 44 which may be turned in one direction to clamp it to rod 37. The other support post 36 for stop member 34 has a similar arrangement including a clamping screw for releasably clamping it at a preselected position along guide rod 38**.

As shown in FIG. 13, upper plate 32 carries a calibrated scale 45 extending along its length away from the edges of its openings **32*a* nearest the fold gap between rollers B and D. The stop member 34 is positioned along guide rods 37 and 38 with its front legs 34*a* aligned with the scale calibration representing the desired page width of the booklet. For example, as shown in full lines in FIG. 13, the stop member 34** may be positioned for a relatively narrow page width or, as shown in phantom, for a greater page width.

In the operation of this folder, a set of superimposed sheets, stapled down the middle, passes down between rollers B and C into the recess between lower plate 30 and upper plate 32 until the leading edges engage the legs **34*a* of stop member 34, after which this stapled set of sheets can move down no farther and begins to flex across the curved top lip 31 of lower plate 30 and to fold along the stapled centerline of the set of sheets. As the trailing half of the set of stapled sheets continues to move down between rollers B and C, the stapled centerline of the set of sheets is pushed to the left in FIG. 12** between rollers B and D. Thus, the stapled centerline becomes the leading edge of the booklet and the leading half of the set of sheets is pulled up between rollers B and D while the trailing half is pulled down between rollers B and C and then between rollers B and D and is superimposed over the leading half.

FIG. 15 shows how the folded booklet looks after it emerges from between rollers B and D. The stapled, folded centerline is the spine of the booklet.

In accordance with one aspect of the present invention, roller D in the folding mechanism is vertically adjustable to different positions with respect to roller B, depending upon the thickness of the stapled set of sheets which is to be folded along its staple line by passing between these rollers from right to left in FIG. 4.

Referring to FIGS. 21–23, the support shaft 201 for roller D is rotatably supported by the vertical leg 202 of a right-angled member having a horizontal leg 203 at its lower end. A lever 204 (FIG. 21) pivoted at 205 near one of its ends presents a transverse segment 206 on its opposite free end which directly overlies leg 203 of the right-angled member 202,203. A coil spring 207 (FIGS. 21 and 23) biases lever 204 upward. A fixedly mounted bracket 208 engages spring 207 from below and the upper end of the spring engages the bottom of a transverse segment 209 on the bottom of lever 204.

A flat-sided stop member 210 (FIG. 21) engages the top of lever segment 209. Stop member 210 is affixed to a shaft 211 (FIG. 22) rotatably supported by bracket 208, which has an outwardly projecting cylindrical neck **208*a* receiving shaft 211. A key 213 for turning shaft 211 is removably coupled to the outer end of this shaft, which projects beyond the bracket neck 208*a*. Stop member 210 presents flat faces 201*a*, 201*b*, 201*c*, 201*d* and 201*e* on its periphery in succession clockwise in FIG. 21. These flat faces are progressively farther out from the axis of shaft 211. That is, face 201*a* is closest to the shaft axis and face 201*e*** is farthest from it.

With spring 207 holding segment 209 of lever 204 up against whichever of these flat faces **210*a*, 210*b*, 210*c*, 210*d* and 210*e* is the bottom face of stop member 210, by using the key 213 to turn stop member 210 the lever 204 can be pivotally adjusted to a corresponding position. Since the free end segment 206 of lever 204 engages leg 203 of the right-angled bracket which supports roller D, the vertical position of the upwardly spring-biased roller D can be adjusted to any of five different positions, as determined by the flats 210*a*, 210*b*, 210*c*, 210*d* and 210*e* on stop member 210**.

Figure 1:
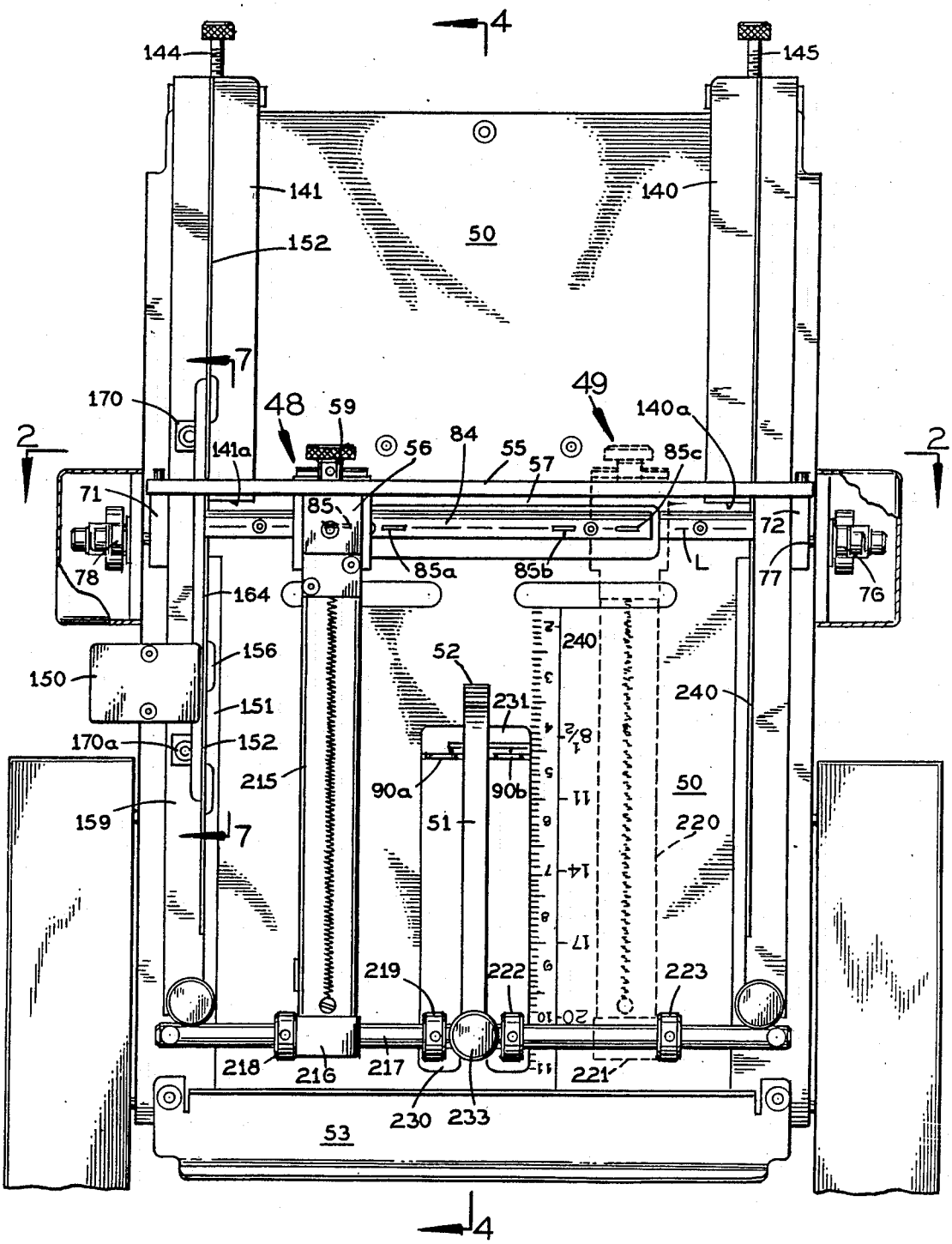
FIG. 1 is a top plan view showing the present booklet maker conversion apparatus on a folder.

Before reaching this folding mechanism, the individual sheets which will make up the booklet, stacked in the correct order, are stapled along their centerlines by two staplers 48 and 49 (FIGs. 1 and 4), after which they slide down through a guide having a flat lower plate 50 which is inclined downward and forward (i.e., toward rollers A, B, C and D) at an angle of about 45 degrees to the vertical and thus at about 90 degrees to the lower and upper plates 30 and 32 in the folding mechanism just described. As shown in FIGS. 1 and 4, the lower guide plate 50 extends in front of and behind a stapling station where staplers 48 and 49 are located. In front of the stapling station the guide has an upper plate 51 which for most of its extent extends parallel to lower plate 50. As shown in FIG. 1, upper guide plate 51 is substantially narrower from side-to-side than lower plate 50 and is centered over it. The space between guide plates 50 and 51 is such that the set of stapled sheets can pass slidably between them. Upper plate 51 has a curved lip 52 at its back end which curves away from lower plate 50 to facilitate the entry of the set of stapled sheets between them.

The lower guide plate 50 extends forward past the upper guide plate 51 at the front end of each of them (the left end in FIG. 4) and it extends part-way across the top of roller C in the folding mechanism. An additional upper guide member 53 extends above and generally parallel to this front end of lower guide plate 50. Guide member 53 extends across the complete width of lower guide plate 50 (FIG. 1). Guide member 53 has a downwardly curving front lip 54 (FIG. 4) which is above and substantially aligned vertically with the nip between rollers B and C. FIG. 12 shows this in enlarged detail, from which it will be evident that the front lip 54 of guide member 53 directs the set of stapled sheets down between rollers B and C.

Figure 2:
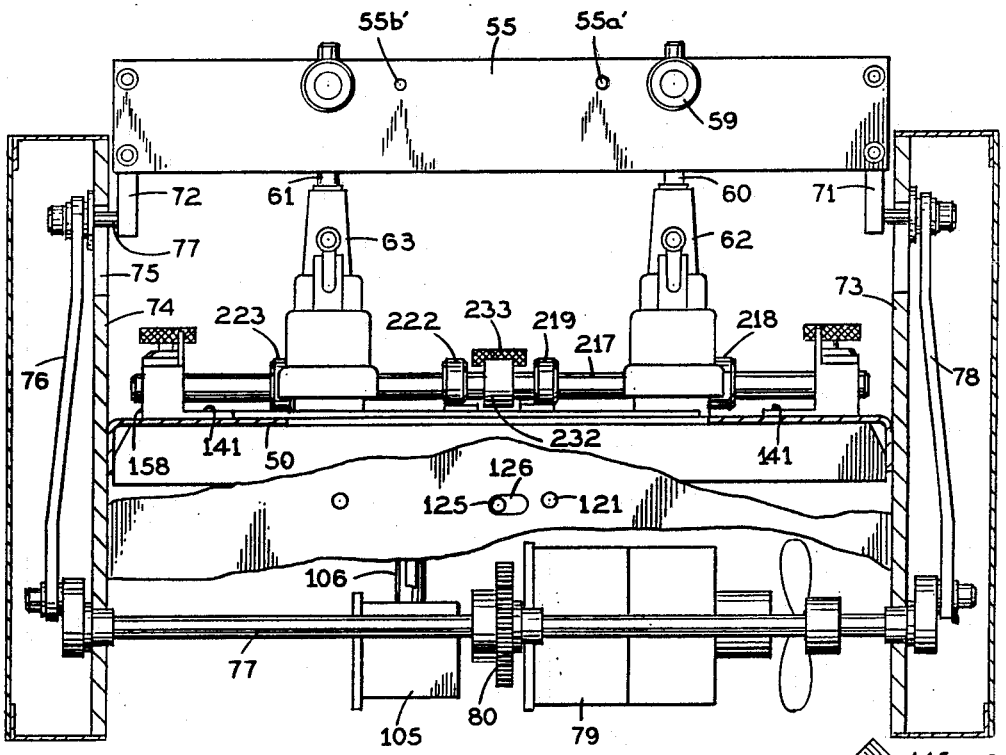
FIG. 2 is a cross-section taken along the line 2—2 in FIG. 1 at an angle downward toward the bottom of FIG. 1.
Figure 3:
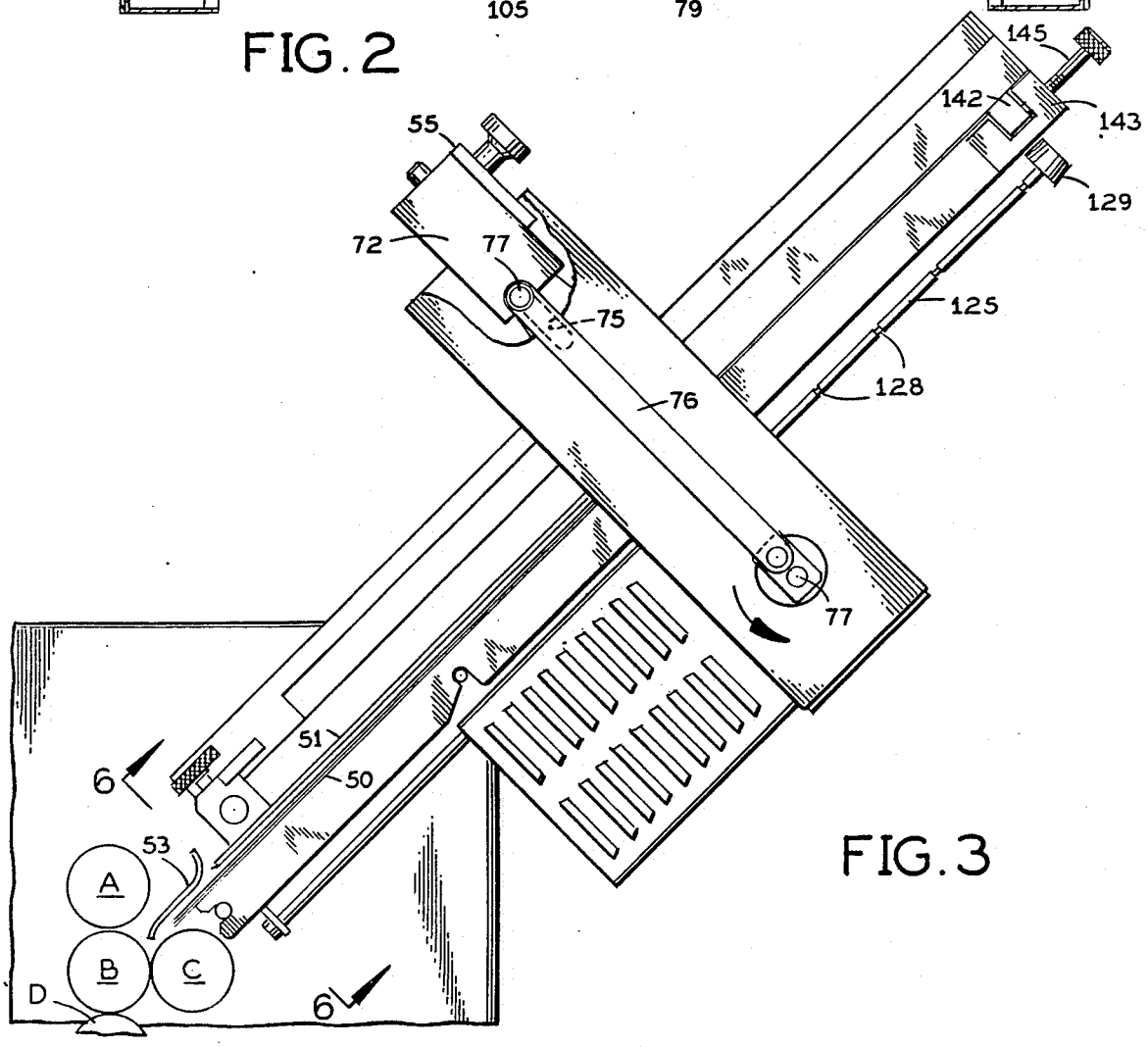
FIG. 3 is a side elevation of the booklet maker conversion apparatus.
Figure 11:
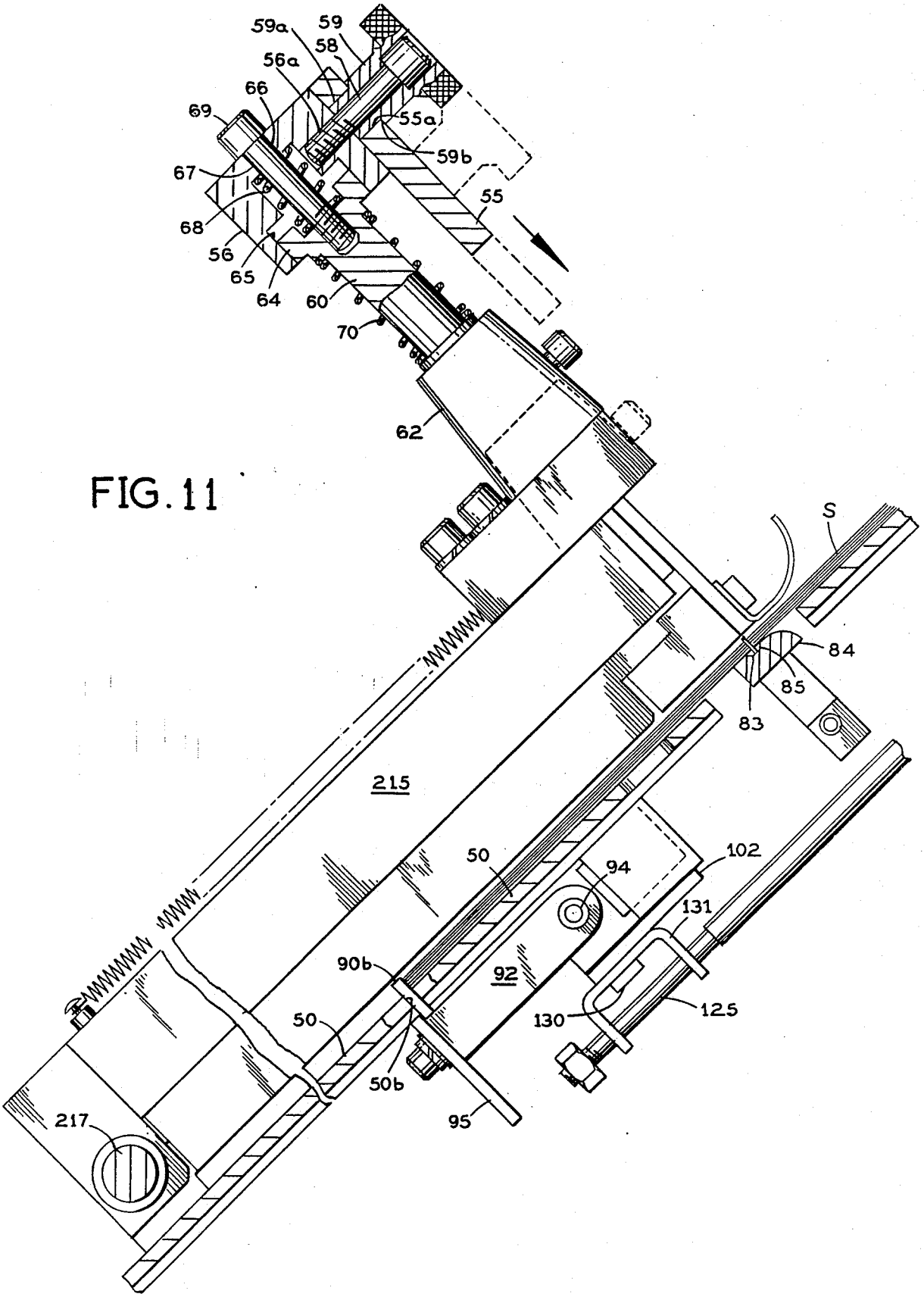
FIG. 11 is a longitudinal section through the booklet maker conversion apparatus generally similar to the upper part of FIG. 4 but on a larger scale and with parts broken away.

As shown in FIGS. 1–3, the framework of the present apparatus has a cross plate 55 at the top which supports the heads 56 and 57 of staplers 48 and 49, respectively. As shown in FIG. 11 for stapler head 56, this attachment is provided by a bolt 58, which is screw-threadedly received in a screw-threaded recess 56*a* in the back of head 56, and a collar 59 holding the bolt. Collar 59 has a reduced cylindrical neck 59*a* on its inner end which is slidably received in, and removable from, a cylindrical opening 55*a* in cross plate 55. Holder 59 presents a transverse annular shoulder 59*b* at the outer end of its neck 59*a* which is engageable with the back face of cross plate 55 when the bolt is tightened. This clamps the stapler head 56 securely to the cross head.

Another opening 55*a*′ (FIG. 2) in cross-head 55 is located a predetermined distance laterally inward from the cross-head opening 55 where the stapler head 56 is positioned in FIGS. 2 and 11. Thus, stapler head 56 can be clamped to cross-head 55 at either of two laterally spaced positions, depending upon the size of the sheets which will be stapled and folded to form the booklet.

Respective plungers 60 and 61 (FIG. 2) are mechanically coupled, respectively, to stapler heads 56 and 57 and extend down slidably through corresponding stapler bodies 62 and 63 below. As shown in FIG. 11 for stapler head 56 and plunger 60, the plunger has an enlargement 64 on its upper end which is slidably received in a complementary recess 65 in the bottom of stapler head 56. A bolt 66 extends down slidably through a top opening 67 in head 56 and is screw-threadedly received at its lower end in the top of plunger 60. A coil spring 68 loosely encircles this bolt and is engaged under compression between stapler head 56 and plunger 60 to provide a resilient cushion between them which permits limited movement of the plunger enlargement 64 upward within the bottom recess 65 in stapler head 56. Normally, spring 68 biases these parts to the position shown in FIG. 11, in which an enlarged head 69 on the top of plunger 66 engages the top face of stapler head 56, so that downward movement of stapler head 56 will produce corresponding downward movement of plunger 60.

A coil spring 70 loosely encircles plunger 60 below the enlargement 64 on its upper end. This spring is engaged under compression between plunger 60 and the top of stapler body 62 and biases this plunger and the stapler head 56 upward.

An identical arrangement is provided at the other stapler head 57 and the plunger 61 mechanically coupled to it. Stapler head 57 may be clamped to the cross-head 55 at either of two laterally spaced openings therein. The innermost one of these two openings, 55*b*′, appears in FIG. 2 and the outer one of these openings is where the stapler head 57 is positioned in this Figure.

Referring to FIG. 2, the cross plate 55 which carries stapler heads 56 and 57 is rigidly attached to downwardly extending end plates 71 and 72 at its opposite ends just inside respective vertical end walls 73 and 74 of the stationary frame of the apparatus. End wall 74 has a vertically elongated slot 75. A crank arm 76 outside this wall is rotatably coupled at its upper end to a rod 77 extending horizontally out from end plate 72 through the vertical slot 75 in wall 74. The lower end of crank arm 76 is rotatably coupled eccentrically to a horizontal, motor-driven, rotary shaft 5′. The end plate 71 at the opposite end of cross plate 55 is similarly coupled to a crank arm 78 driven by shaft 5′. Shaft 5′ is driven from an electric motor 79 through gearing 80.

With this arrangement the cross plate 55 is moved up and down when motor 79 is on. Stapler heads 56 and 57 move up and down in unison with cross plate 55. The plungers 60 and 61 coupled to stapler heads 56 and 57, as described, operate staple drivers below, which drive a pair of staples 81 and 82 into a stack of rectangular sheets of paper, as shown in FIG. 14, along the centerline LC which will be the fold line of the booklet. FIG. 11 shows the staple driver 83 which is operated by plunger 60. Below this and the other staple driver a fixed anvil 84 presents an upwardly-facing groove 85 aligned with driver 83 in this position of stapler head 56 on cross plate 55.

As shown in FIG. 1, the anvil 84 has three more recesses 85*a*,85*b* and 85*c* at different locations across the anvil. For narrower sheets the two staplers are positioned over the anvil recesses 85*a* and 85*b* so that the staples in the booklet will be correspondingly close to each other. For wider sheets the two staplers are positioned over the outermost anvil recesses 85 and 85*c*, as shown in FIG. 1. In this position of the parts, the stapler heads 56 and 57 are clamped to cross-head 55 at its outer openings.

The stapler 48 has an elongated base 215 which carries a staple magazine. As shown in FIG. 1, this stapler base has a body 216 on its front end which is slidable along a cross shaft 217 that is fixedly mounted in the framework of the machine. Stop collars 218 and 219 on the cross shaft provide outer and inner limit stops for the stapler body 216. When the stapler body 216 engages the outer limit stop 218, the stapler 48 is aligned with recess 85 in anvil 84. When the stapler body 216 engages the inner limit stop 219, the stapler 48 is aligned with anvil recess 85*a*.

Similarly, the other stapler 49 has an elongated base 220 which carries a staple magazine and has a body 221 on its front end slidable along cross shaft 217. Stop collars 222 and 223 on the cross shaft provide inner and outer limit stops for the stapler body 221. When stapler body 221 engages the outer limit stop 223, the stapler 49 is aligned with anvil recess 85*c*. When stapler body 221 engages the inner limit stop 222, the stapler 49 is aligned with anvil recess 85*b*.

The leading edge of the stack of sheets in the stapler engages a stop which holds the stack stationary while it is being stapled.

Figure 5:
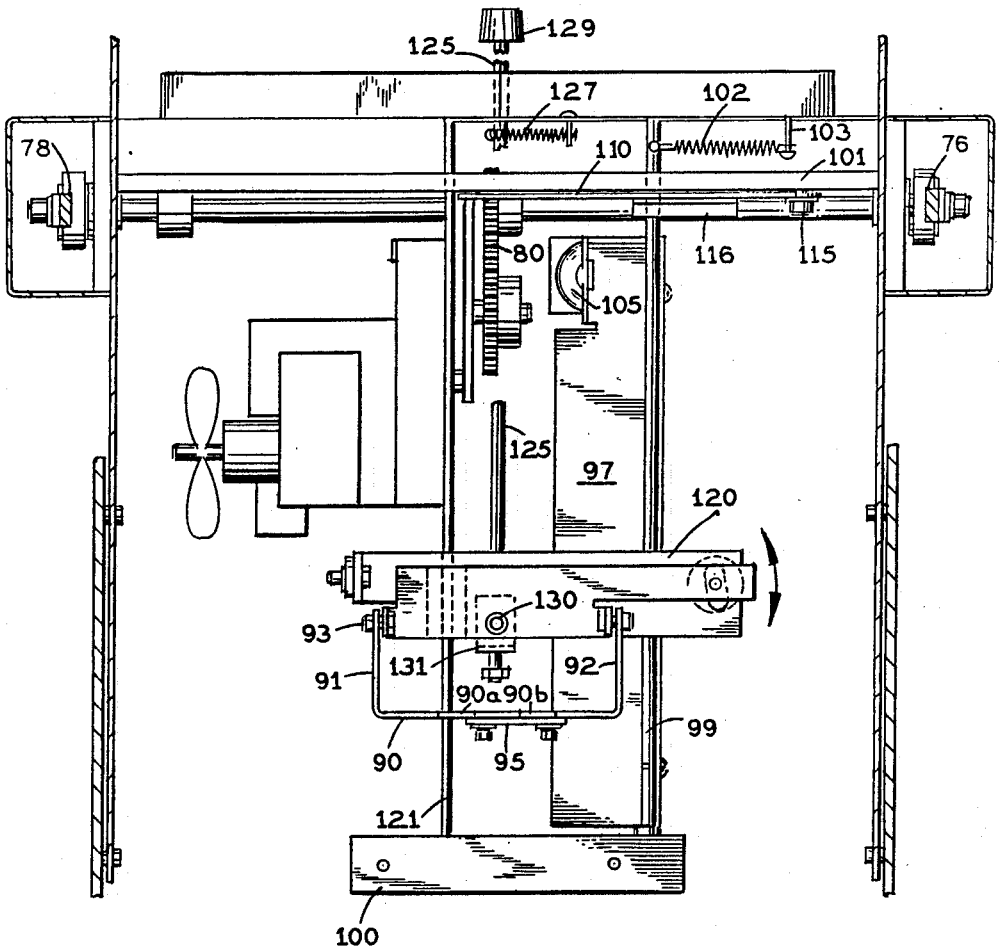
FIG. 5 is a bottom plan view of the booklet maker conversion apparatus.

Referring to FIG. 5, this stop is provided by a three-sided channel member having a front segment 90 and opposite end legs 91 and 92 which extend rearward from the front segment and are pivoted on aligned, horizontal cross pins 93 and 94 on a support body 120.

The front segment has upwardly projecting fingers 90a and 90b (FIG. 6) which are engaged by the leading edge of the stack of sheets in the stapler when channel member 90–92 is in its normal raised position. This is shown in enlarged detail for finger 90b in FIG. 11.

As shown in FIG. 1, the lower plate 50 of the sheet guide in front of the staplers has two openings 230 and 231 which are elongated in the direction of movement of the sheets and are closely spaced on opposite sides of the longitudinal centerline of plate 50. The narrow upper guide plate 51 is located above and between these openings. As shown in FIG. 4, close to its front end the upper guide plate 51 is affixed to the bottom of an apertured support block 232 which is slidably mounted on cross shaft 217. A clamping screw 233 extends down screw-threadedly in block 232 and is engageable with the top of cross shaft 217 to hold the block in place on the cross shaft when the clamping screw is tightened.

The stop fingers 90a and 90b on stop member 90 are loosely received in the openings 230 and 231 in lower guide plate 50, as shown in FIG. 1.

A front plate 95 (FIGS. 4 and 5) is rigidly attached to front segment 90 of the stop member and extends downward and rearward from it at an acute angle to the vertical. A rigid link 97 (FIG. 6) of L-shaped cross-section has the free end of its long leg slidably received in a slot 96 formed in the front plate 95 near its lower right corner. Link 97 is rigidly attached to a rotatably mounted shaft 99. As shown in FIG. 5, both the L-shaped link 97 and shaft 99 are elongated from front-to-back.

Figure 18:
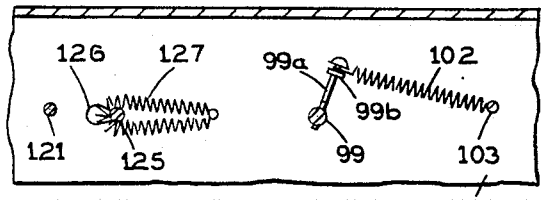
FIG. 18 is a fragmentary cross-section taken along the line 18—18 in FIG. 17.

At its front end, shaft 99 is rotatably supported by a right-angled bracket 100. As shown in FIG. 4, bracket 100 is affixed to the bottom of the lower guide plate 50 near its lower front end. Toward its back end, shaft 99 is rotatably supported by a cross-wall 101 (FIG. 5) which extends from side-to-side in the stationary framework of the machine. A tension spring 102 acts between shaft 99 (close to its back end) and a pin 103 attached to a back wall 104 of the stationary framework. As shown in FIG. 18, shaft 99 carries an upwardly extending bolt 99a on which a nut 99b is threaded to hold the end of spring 102 up against the head of this bolt. Spring 102 biases shaft 99 clockwise (viewed from the front) and raises link 97 to the position shown in FIG. 6, in which it holds the stop member 90–92 up with its fingers 90a and 90b projecting up through the openings 230 and 231 in lower guide plate 50 on opposite sides of the upper guide plate 51. In this raised position the stop fingers 90a and 90b block the stack of paper sheets in the stapler at the leading edge of the stack.

Figure 19:
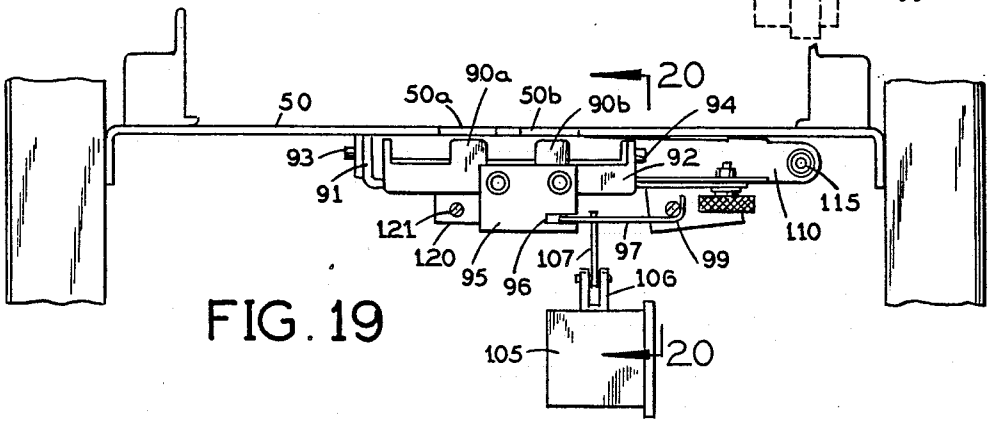
FIG. 19 is a cross-section taken in front of the stop for the leading edge of the stack of papers to be stapled and showing the stop lowered.
Figure 20:
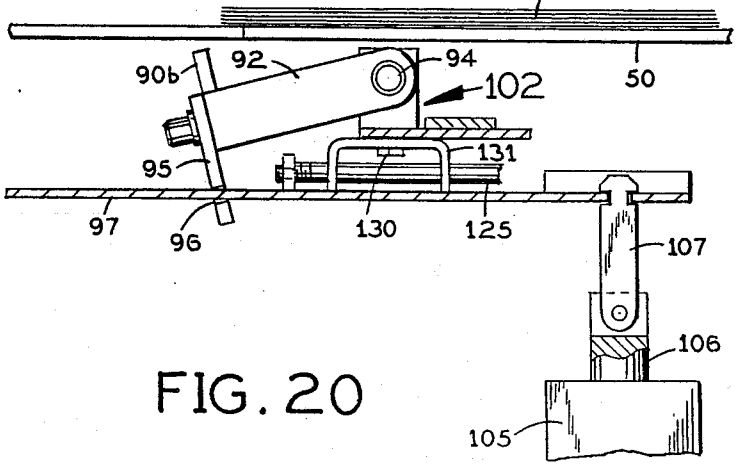
FIG. 20 is a fragmentary longitudinal section taken along the line 20—20 in FIG. 19 and showing the stop and its adjustable support.

A solenoid 105 (FIGS. 5 and 6) is located beneath link 97 near its back end. Solenoid 105 has a vertically reciprocable plunger 106 which is pivotally coupled to the lower end of a link arm 107, the upper end of which is pivotally coupled to link 97, as shown in FIG. 20. When solenoid 105 is energized, it pulls its plunger 106 down and through the link 107 it pulls link 97 down from the normal, raised position shown in FIG. 6 to the lowered position shown in FIG. 19. Link 97 pulls stop member 90–92 down to a position in which its stop fingers 90a and 90b are completely below the lower guide plate 50, as shown in FIG. 19. In this lowered position the stop fingers permit the stack of stapled sheets of paper to slide down into the folding mechanism.

A pivoted kicker blade 110 (FIGS. 5,16 and 17) is located a short distance behind the staple line of the staplers and immediately in front of cross-wall 101. As shown in FIG. 17, this blade has an upwardly projecting top segment 111 at its free left end which can pass through a slot 112 formed in lower guide plate 50. Blade 110 is pivoted at 115, near its right end in FIG. 17. A rectangular block 116 is rigidly attached to shaft 99 and is formed on the back with a tapered undercut which is open at the top and receives the bottom of blade 110. This undercut is of progressively diminishing depth from left to right in FIG. 17 so that the top right edge 117 of block 116 acts as a cam pushing up on the bottom edge of blade 110 when shaft 99 is turned counterclockwise.

Normally, spring 102 biases shaft 99 clockwise in FIG. 17 and holds block 116 up with its undercut on the back receiving the bottom of kicker blade 110. When solenoid 105 is energized it pulls down on link 97, as described, causing shaft 99 to rotate counterclockwise. Block 116 turns counterclockwise in unison with shaft 99 and its right top edge 117 slides across the bottom edge of blade 110, rocking this blade clockwise in FIG. 17 on its pivot 115 and moving its top segment 111 up through the opening 112 in lower guide plate 50 to strike from below the stapled set of sheets in the stapler.

Thus, the blade 110 strikes the stapled set of sheets from below a short distance behind its staple line substantially simultaneously with the downward retraction of stop fingers 90a and 90b from in front of the leading edge of this set of papers. This insures that the just-stapled set of sheets slides forward down the lower guide plate 50 to the folding mechanism.

Figure 6:
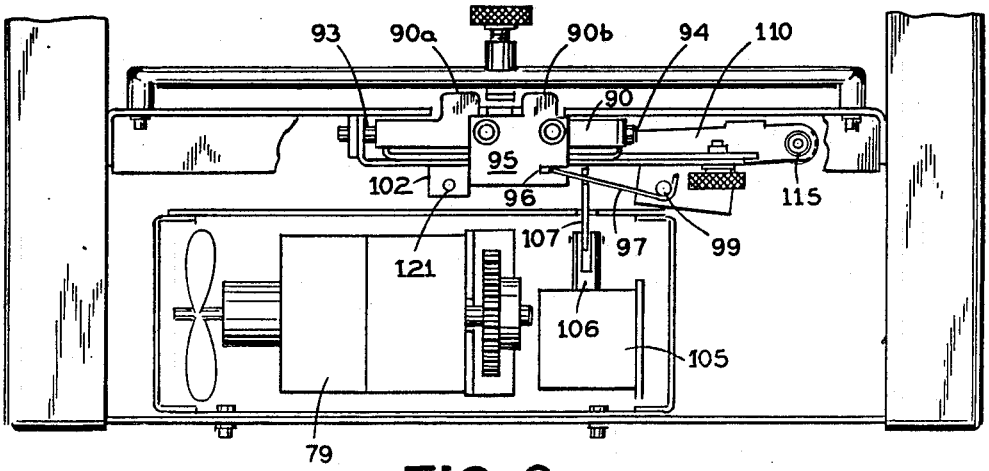
FIG. 6 is a cross-section taken along the line 6—6 in FIG. 3 between the exit end of the stapling apparatus and the inlet of the folding mechanism.
Figure 16:
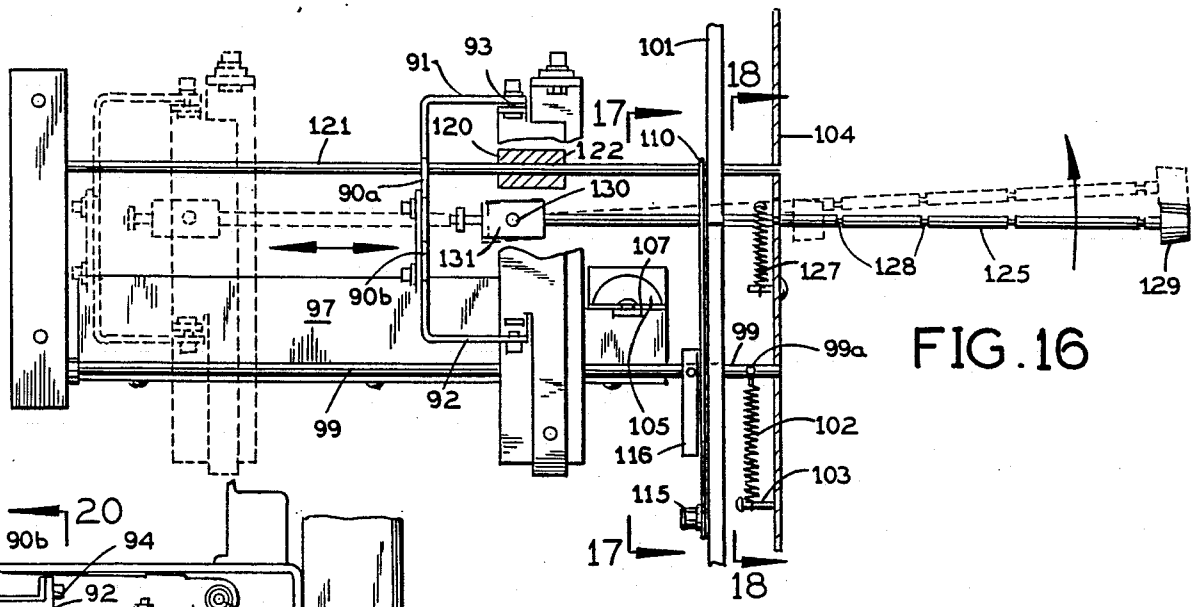
FIG. 16 is a fragmentary cross-section showing the adjustable stop for the leading edge of a stack of paper sheets to be stapled and then folded into a booklet.
Figure 17:
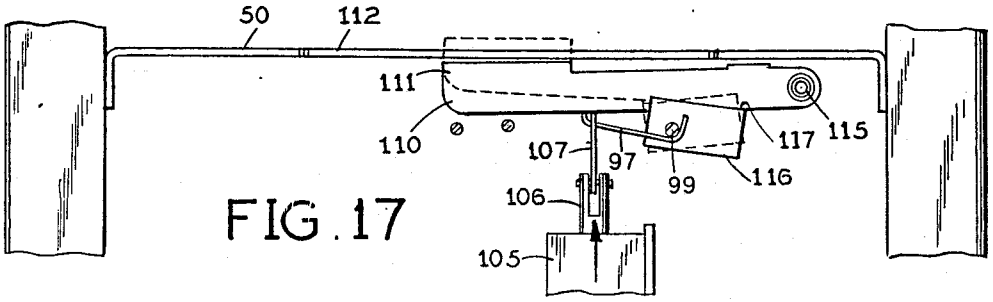
FIG. 17 is a cross-section taken along the line 17—17 in FIG. 16 and showing the kicker located near the staple line and operating in synchronism with the stop of FIG. 16 to strike the stapled set of sheets from below when the stop releases the leading edge of this set of sheets.

As shown in FIGS. 5,6 and 16, the support body 120 on which stop member 90–92 is pivotally mounted is adjustably positionable in a front-to-back direction to accommodate various sizes of the sheets. A fixed shaft 121 extends between bracket 100 on the bottom of lower guide plate 50 and the framework wall 104. The support body 120 has an opening 122 (FIG. 16) which slidably receives shaft 121 so that the support body can be slid along this shaft.

A positioning rod 125 (FIG. 16) for the support body extends through a tapered opening 126 (FIG. 18) in wall 104 of the framework. A coil spring 127 (FIG. 18) extends around the positioning rod 125 and has its opposite ends anchored to wall 104 on the side of opening 126 where its narrow end is, so this spring pulls rod 125 into the narrower end of this opening. Positioning rod 125 has a series of evenly spaced circumferential grooves 128 for locking engagement with wall 104 at the narrow end of slot 126 to hold rod 125 in the corresponding position front-to-back in the machine. Rod 125 has a knob 129 on its back end which may be pushed in the direction shown by the arrow in FIG. 16 to release a groove 128 on the rod from locking engagement with wall 104 at the narrow end of opening 126 and force the rod toward the wide end of this opening, permitting the rod to be shifted lengthwise to position a different groove 128 along its length in the wall opening 126.

The support body 120 for stop member 90–92 is pivotally mounted at 130 on top of an inverted channel 131 (FIG. 20) which is welded or otherwise rigidly connected to positioning rod 125 near its front end.

The positioning rod 125 can be displaced longitudinally in either direction to position the stop member 90–92 at a corresponding distance in front of the staplers 48 and 49. The slot 96 in stop plate 95 is wide enough to permit stop plate 95 to slide along link 97 without difficulty. The positioning rod 125 can be locked in any selected longitudinal position determined by the reception of a corresponding rod groove 128 in the tapered opening 126 in wall 104.

Referring to FIG. 1, to the right of its opening 231 the lower guide plate 50 displays a scale 240 which is calibrated in inches or other distance units forward from the staple line L which extends through the recess 85,85*a*,85*b* and 85*c* in anvil 84. The positioning rod 125 is adjusted longitudinally to position the stop finger 90*b* at the calibration on scale 240 which corresponds to the desired single-page width for the booklet.

Referring to FIG. 1, behind and in front of the staplers 48 and 49 the apparatus has an adjustable-width support arrangement for the stack of sheets to be stapled and then folded into a booklet. Behind the staplers this support arrangement is provided by rigid holders which present flat, inwardly-extending, bottom legs 140 and 141, respectively. As shown in FIG. 2, these bottom inner legs of the holders rest on the lower guide plate 50 behind the staplers. As shown in FIG. 1, the bottom inner legs 140 and 141 terminate at their front lower ends close to the staplers, where they present front edges 140*a* and 141*a*.

The holder on the left side in FIG. 1 has a sidewall 152 which extends perpendicuarly up from its bottom inner leg 141. Sidewall 152 extends forward (and downward) past the front edge 141*a* of bottom leg 141 and continues in front of the stapler 48 for most of the length of lower guide plate 50. In front of stapler 48 the holder on the left side presents a flat, inwardly-extending, bottom leg 151 joined integrally to sidewall 152 at its lower end, as shown in FIG. 8. Bottom inner leg 151 of this holder rests on the lower guide plate 50 in front of the staplers. As shown in FIG. 10, the sidewall 152 is part of a hollow segment of generally rectangular cross-section having a bottom wall 157 which is an extension of the inwardly-extending bottom leg 151, an outer wall 158 extending up from the outer edge of bottom wall 157 parallel to sidewall 152, and a thicker top wall 159 extending in from the upper edge of outer wall 158 and joined integrally to sidewall 152 about half-way up. As shown in FIG. 1, this hollow segment of the support extends the entire length of sidewall 152, both behind and in front of the staplers, and it projects beyond the front end of sidewall 152.

On the right side of the apparatus in FIG. 1, the bottom inner leg 140 is part of a holder which is a mirror image of the holder on the left side as described thus far. This right-side holder has a sidewall 252 extending up from the bottom inner leg 140 behind the staplers and continuing in front of the staplers, where a bottom inner leg 251 extends in from it. The right-side holder also has a hollow segment extending along the outside of the lower half of its sidewall 252 behind and in front of the staplers.

The two holders are adjustable laterally toward and away from each other, depending upon the width of the paper sheets which are to be stapled. Referring to FIG. 4, at its back end the holder on the left side has a cross-bar 142 of solid rectangular cross-section rigidly attached to its bottom inner leg 140. A fixed channel-shaped guide 143 slidably receives cross-bar 142. A clamping screw 144 is screw-threadedly received in the rear leg of guide 143 and its inner end is engageable with cross-bar. With this arrangement, after loosening the clamping screw 144, the holder on the left side may be slidably adjusted in or out to the desired lateral position, and then the screw 144 may be tightened against cross-bar 142 to hold it in this position.

The holder on the right side has an identical arrangement, including a clamping screw 145 (FIG. 1).

Just before being stapled, the stack of papers can be jogged to bring their edges into precise alignment by rapidly alternately energizing and de-energizing a solenoid 150, located on the right side of the machine in FIG. 1 in front of staplers 48 and 49.

As shown in FIG. 8, along this side the stack of sheets to be jogged rests on the bottom inner legs 141 and 151 of the holder. As shown in FIG. 7, the sidewall 152 of this holder is formed with three rectangular openings 153,154 and 155 at irregular intervals along its length. As shown in FIG. 8, at the bottom of opening 154 in sidewall 152, the adjoining bottom leg 151 has a registering slot 156. This is also true at the bottom of each of the other openings 153 and 155. Openings 153 and 154 are at the front of the staplers; opening 155 is behind the staplers.

As shown in FIG. 8, the top wall 159 of the hollow segment on the outside of this holder is recessed at 160 behind the opening 154 in the inner sidewall 152, and the opening 154 extends up above the top wall 159. This is also the case at each of the other openings 153 and 155 in the inner sidewall 152 of the holder.

The solenoid 150 is on a flat plate 161 bolted on top of the top wall 159 of the holder. The solenoid has a horizontally reciprocable plunger 162 extending in toward the upper edge of the inner sidewall 152 of the holder. This plunger is pivotally coupled at 163 to the outwardly-bent top leg 164 of a jogging plate. This jogging plate also has a flat upper segment 165 joined to the inner end of its top leg 164 and extending down from it immediately outside the inner sidewall 152 of the holder above the opening 154 therein and down into recess 160 in the top wall 159 of the holder. The jogging plate has a connecting segment 166 joined to the lower end of its upper segment 165 and projecting laterally inward from the top wall recess 160 into the inner sidewall opening 154, and a lower flat segment 167 extending down from the connecting segment 166 and received in the inner sidewall opening 154 and in the slot 156 in the inner leg 151 of the holder.

The top leg 164 and the upper segment 165 of the jogging plate at the sidewall opening 154 (FIG. 7) extend on opposite sides of this opening and are joined integrally to a jogging plate 168 at sidewall opening 153 and a jogging plate 169 at sidewall opening 155, both identical to the just-described jogging plate at sidewall opening 154.

As shown in FIGS. 7,9 and 10, a block 170 is bolted at 171 to the top wall 159 of this holder next to the sidewall opening 155. This block carries a pin 172 on one side of bolt 171 which is loosely received in an opening 173 in the upper segment 165 of the jogging plate there. On the opposite side of bolt 171, a coil spring 174 is received in a recess 175 in block 170 and is under compression between the block and the jogging plate.

Referring to FIG. 7, an identical block 170*a*, pin 172*a* and spring 174*a* are provided next to the opening 153 in the sidewall of the holder.

Springs 174 and 174*a* bias the jogging plates to the position shown in full lines in FIG. 8 for the jogging plate at sidewall opening 154. When solenoid 150 is energized, it pulls in its plunger 162 and pivots the jogging plate assembly to the position shown in phantom in FIG. 8 for the jogging plate assembly at the sidewall opening 154. This movement of this jogging plate and the jogging plates 168 and 169 at the other sidewall openings pushes in against the adjacent edge of the stack of sheets and forces the opposite edge of the stack of sheets against the sidewall 252 of the holder on the right side, both behind and in front of the staplers. At the same time, gravity urges the leading edges of this stack of sheets against stop fingers 90*a* and 90*b*.

With this arrangement when the solenoid 150 is alternately energized and de-energized in rapid succession the jogging plates vibrate in and out at the openings 153,154 and 155 in the inner sidewall 152 of the holder at the left side of the apparatus in FIG. 1. This vibration of the jogging plates pushes the stack of sheets against the sidewall 252 of the fixed holder on the right side, thus insuring that the respective side edges of the stack of sheets in the stapler are lined up in proper registration.

OPERATION

In the use of this apparatus, the stack of sheets which will be made into a booklet will have been collated before being placed in the holders behind the staplers 48 and 49, resting on the bottom inner legs 140 and 141 of these holders. The stack of sheets then is slid forward beneath the staplers so that the front part of the stack rests on the bottom inner legs 151 and 251 of the respective holders in front of the staplers while the back part of the stack rests on the bottom inner legs 140 and 141 of the holders. The holders can be adjusted laterally in or out so that the stack of sheets is snugly but slidably received between their sidewalls 152 and 252. The position of the stop fingers 90*a* and 90*b* longitudinally of the apparatus (i.e., toward or away from the stapler anvil 84) is adjusted so that the centerline of the stack of sheets (midway between its leading and trailing edges) registers with the staple line L in FIG. 1. This registration is determined by the engagement of the leading edge of the stack of sheets with the stop fingers 90*a* and 90*b*. As already described, the positioning rod 125 determines the distance of the stop fingers 90*a* and 90*b* in front of the staple line L and thus the page width of the finished booklet. The solenoid 150 vibrates the jogging plates on the left side in FIG. 1 to bring the stacked sheets into close registration along their edges.

The staplers 48 and 49 are positioned either at their laterally inward positions, relatively close together, where the anvil recesses 85*a* and 85*b* are located, or at their laterally outward positions, farther apart, where the anvil recesses 85 and 85*c* are located.

The motor 79 moves the stapler cross-head 55 down and back up, and when the stapler heads 56 and 57 move down, two staples are driven into the stack of sheets, as shown at 81 and 82 in FIG. 14.

After this stapling operation, solenoid 105 is energized to lower the stop fingers 90*a* and 90*b* in front of the leading edge of the just-stapled set of sheets and to move the kicker blade 110 up against the stapled set of sheets a short distance behind the staple line. Consequently, the stapled set of sheets slides down across the lower guide plate 50, beneath the upper guide plate 51, and then beneath the front guide member 53 and between rollers B and C, and then down into the folding mechanism.

I claim:

1. In combination with a folder having:

a pair of power-driven rollers operatively arranged to pull down between them a stapled set of sheets of paper;

guide members extending down from said pair of rollers on one side thereof, said guide members defining a downwardly inclined guide recess located on said one side of said pair of rollers, said guide recess having an open upper end positioned to receive the stapled set of sheets pulled down by said pair of rollers;

a stop member positioned in said guide recess in the path of said stapled set of sheets for engagement by the leading edge of said stapled set of sheets to prevent the continued advance of said set of sheets down into said guide recess;

and a third roller positioned below one of said pair of rollers and cooperable therewith to define a fold gap through which said stapled set of sheets is pulled after said leading edge of said stapled set of sheets engages said stop member and the trailing part of the stapled set of sheets continues to be pulled down between said pair of rollers;

the improvement which comprises a stapling and guide unit attached to said folder above said pair of rollers, said stapling and guide means having:

a stapling station including a power-operated stapling mechanism located above and on said one side of said pair of rollers;

guide means located above and on said one side of said pair of rollers and inclined downward and forward from said stapling station toward said pair of rollers for passing a stapled set of sheets in a straight-line path from said stapling mechanism down to said pair of rollers;

stop means in said guide means spaced from said stapling mechanism by substantially half the length of each sheet and normally positioned for engagement by the leading edge of a stack of sheets in said stapling station to hold said stack against movement down said guide means to said pair of rollers and to position the longitudinal midpoint of each sheet beneath said stapling mechanism;

and means for retracting said stop means from engagement by the leading edge of said stack of sheets when said stapling mechanism staples said stack into a stapled set of said sheets, thereby permitting said stapled set of sheets to pass down said guide means to said pair of rollers.

2. The combination of claim 1 wherein said guide means comprises:

lower guide plate means inclining down toward said pair of rollers, said lower guide plate means extending forward from said stapling station toward said pair of rollers and extending behind said stapling station;

and laterally spaced holders extending up from said lower guide plate means behind and in front of said stapling station for slidably receiving between them, and for engaging the opposite side edges of, a stack of sheets to be stapled and folded into a booklet.

3. The combination of claim 2 and further comprising:

vibratory jogging members on one of said holders for pushing the stack of sheets against the other of said holders.

4. The combination of claim 3 and further comprising:

means for selectively adjusting said holders toward and away from each other.

5. The combination of claim 2 and further comprising:

means for selectively adjusting said holders toward and away from each other.

6. The combination of claim 4 wherein:

said lower guide plate means is apertured to pass said stop means;

and further comprising:

means normally positioning said stop means to extend up through said apertured lower guide plate means in front of said stapling station for engagement by the leading edge of a stack of sheets in said stapling station;

and means for lowering said stop means below said lower guide plate means to permit a stapled set of sheets to slide down said lower guide plate means to said pair of rollers.

7. The combination of claim 1 and further comprising:

means for jogging the stack of sheets in said stapling station to align their edges.

8. The combination of claim 1 wherein:

said guide means comprises an apertured lower guide plate inclining down from said stapling station to said pair of rollers;

and further comprising:

means for normally positioning said stop means to extend up through said apertured lower guide plate for engagement with the leading edge of each of a stack of sheets in said stapling station;

and means for lowering said stop means below said lower guide plate to permit a stapled set of said sheets to slide down said lower guide plate to said pair of rollers.

9. In combination with a folder having:

a pair of power-driven rollers operatively arranged to pull down between them a stapled set of sheets of paper;

guide members extending down from said pair of rollers on one side thereof, said guide members defining a downwardly inclined guide recess located on said one side of said pair of rollers, said guide recess having an open upper end positioned to receive the stapled set of sheets pulled down by said pair of rollers;

a stop member positioned in said guide recess in the path of said stapled set of sheets for engagement by the leading edge of said stapled set of sheets to prevent the continued advance of said set of sheets down into said guide recess;

and a third roller positioned below one of said pair of rollers and cooperable therewith to define a fold gap through which said stapled set of sheets is pulled after said leading edge of said stapled set of sheets engages said stop member and the trailing part of the stapled set of sheets continues to be pulled down between said pair of rollers;

the improvement which comprises a stapling and guide unit attached to said folder above said pair of rollers, said stapling and guide means having:

a stapling station including a power-operated stapling mechanism located above and on said one side of said pair of rollers;

guide means inclined downward and forward from said stapling station toward said pair of rollers for passing a stapled set of sheets from said stapling mechanism down to said pair of rollers, said guide means comprising: lower guide means inclining down toward said pair of rollers, said lower guide plate means extending forward from said stapling station toward said pair of rollers and extending behind said stapling station, laterally spaced holders extending up from said lower guide plate means behind and in front of said stapling station for slidably receiving between them a stack of sheets to be stapled and folded into a booklet, and means for selectively adjusting said holders toward and away from each other;

stop means in said guide means normally positioned for engagement by the leading edge of a stack of sheets in said stapling station to hold said stack against movement down said guide means to said pair of rollers;

means for retracting said stop means from engagement by the leading edge of said stack of sheets when said stapling mechanism staples said stack into a stapled set of said sheets, thereby permitting said stapled set of sheets to pass down said guide means to said pair of rollers;

said lower guide plate means being apertured to pass said stop means;

means normally positioning said stop means to extend up through said apertured lower guide plate means in front of said stapling station for engagement by the leading edge of a stack of sheets in said stapling station;

means for lowering said stop means below said lower guide plate means to permit a stapled set of sheets to slide down said lower guide plate means to said pair of rollers;

and means for selectively adjusting said stop means along said lower guide plate means toward and away from said stapling station.

10. The combination of claim 9 and further comprising:

a kicker plate below said lower guide plate means near said stapling station;

means normally positioning said kicker plate below said guide plate means;

said lower guide plate means having an opening therein for passing said kicker plate;

and means for moving said kicker plate up through said opening in said lower guide plate means to strike the stapled set of sheets from below in timed relation with the lowering of said stop means.

11. The combination of claim 10 and further comprising:

means for selectively adjusting said third roller vertically to provide a corresponding gap between said third roller and said one roller of said pair of rollers.

12. In combination with a folder having:

a pair of power-driven rollers operatively arranged to pull down between them a stapled set of sheets of paper;

guide members extending down from said pair of rollers on one side thereof, said guide members defining a downwardly inclined guide recess located on said one side of said pair of rollers, said guide recess having an open upper end positioned to receive the stapled set of sheets pulled down by said pair of rollers;

a stop member positioned in said guide recess in the path of said stapled set of sheets for engagement by the leading edge of said stapled set of sheets to prevent the continued advance of said set of sheets down into said guide recess;

and a third roller positioned below one of said pair of rollers and cooperable therewith to define a fold gap through which said stapled set of sheets is pulled after said leading edge of said stapled set of sheets engages said stop member and the trailing part of the stapled set of sheets continues to be pulled down between said pair of rollers;

the improvement which comprises a stapling and guide unit attached to said folder above said pair of rollers, said stapling and guide means having:

a stapling station including a power-operated stapling mechanism located above and on said one side of said pair of rollers;

guide means inclined downward and forward from said stapling station toward said pair of rollers for passing a stapled set of sheets from said stapling mechanism down to said pair of rollers;

stop means in said guide means normally positioned for engagement by the leading edge of a stack of sheets in said stapling station to hold said stack against movement down said guide means to said pair of rollers;

means for retracting said stop means from engagement by the leading edge of said stack of sheets when said stapling mechanism staples said stack into a stapled set of said sheets, thereby permitting said stapled set of sheets to pass down said guide means to said pair of rollers;

said guide means comprising an apertured lower guide plate inclining down from said stapling station to said pair of rollers;

means for normally positioning said stop means to extend up through said apertured lower guide plate for engagement with the leading edge of each of a stack of sheets in said stapling station;

means for lowering said stop means below said lower guide plate to permit a stapled set of said sheets to slide down said lower guide plate to said pair of rollers;

and means for selectively adjusting said stop means along said apertured lower guide plate toward and away from said stapling station.

13. The combination of claim 12 and further comprising:

a kicker plate below said lower guide plate near said stapling station;

means normally positioning said kicker plate below said lower guide plate;

said lower guide plate having an opening therein for passing said kicker plate;

and means for moving said kicker plate up through said opening in said lower guide plate to strike the stapled set of sheets from below in timed relation with the lowering of said stop means.

14. In combination with a folder having:

a pair of power-driven rollers operatively arranged to pull down between them a stapled set of sheets of paper;

guide members extending down from said pair of rollers on one side thereof, said guide members defining a downwardly inclined guide recess located on said one side of said pair of rollers, said guide recess having an open upper end positioned to receive the stapled set of sheets pulled down by said pair of rollers;

a stop member positioned in said guide recess in the path of said stapled set of sheets for engagement by the leading edge of said stapled set of sheets to prevent the continued advance of said set of sheets down into said guide recess;

and a third roller positioned below one of said pair of rollers and cooperable therewith to define a fold gap through which said stapled set of sheets is pulled after said leading edge of said stapled set of sheets engages said stop member and the trailing part of the stapled set of sheets continues to be pulled down between said pair of rollers;

the improvement which comprises a stapling and guide unit attached to said folder above said pair of rollers, said stapling and guide means having:

a stapling station including a power-operated stapling mechanism located above and on said one side of said pair of rollers;

guide means inclined downward and forward from said stapling station toward said pair of rollers for passing a stapled set of sheets from said stapling mechanism down to said pair of rollers;

stop means in said guide means normally positioned for engagement by the leading edge of a stack of sheets in said stapling station to hold said stack against movement down said guide means to said pair of rollers;

means for retracting said stop means from engagement by the leading edge of said stack of sheets when said stapling mechanism staples said stack into a stapled set of said sheets, thereby permitting said stapled set of sheets to pass down said guide means to said pair of rollers;

and means for selectively adjusting said stop means along said guide means toward and away from said stapling station.

15. In combination with a folder having:

a pair of power-driven rollers operatively arranged to pull down between them a stapled set of sheets of paper;

guide members extending down from said pair of rollers on one side thereof, said guide members defining a downwardly inclined guide recess located on said one side of said pair of rollers, said guide recess having an open upper end positioned to receive the stapled set of sheets pulled down by said pair of rollers;

a stop member positioned in said guide recess in the path of said stapled set of sheets for engagement by the leading edge of said stapled set of sheets to prevent the continued advance of said set of sheets down into said guide recess;

and a third roller positioned below one of said pair of rollers and cooperable therewith to define a fold gap through which said stapled set of sheets is pulled after said leading edge of said stapled set of sheets engages said stop member and the trailing part of the stapled set of sheets continues to be pulled down between said pair of rollers;

the improvement which comprises a stapling and guide unit attached to said folder above said pair of rollers, said stapling and guide means having:

a stapling station including a power-operated stapling mechanism located above and on said one side of said pair of rollers;

guide means inclined downward and forward from said stapling station toward said pair of rollers for passing a stapled set of sheets from said stapling mechanism down to said pair of rollers;

stop means in said guide means normally positioned for engagement by the leading edge of a stack of sheets in said stapling station to hold said stack against movement down said guide means to said pair of rollers;

means for retracting said stop means from engagement by the leading edge of said stack of sheets when said stapling mechanism staples said stack into a stapled set of said sheets, thereby permitting said stapled set of sheets to pass down said guide means to said pair of rollers;

and a kicker plate at said stapling station operable to strike the stapled set of sheets from below in timed relation with the retraction of said stop means from engagement by the leading edge of said stapled set of sheets.

16. In combination with a folder having:

a pair of power-driven rollers operatively arranged to pull down between them a stapled set of sheets of paper;

guide members extending down from said pair of rollers on one side thereof, said guide members defining a downwardly inclined guide recess located on said one side of said pair of rollers, said guide recess having an open upper end positioned to receive the stapled set of sheets pulled down by said pair of rollers;

a stop member positioned in said guide recess in the path of said stapled set of sheets for engagement by the leading edge of said stapled set of sheets to prevent the continued advance of said set of sheets down into said guide recess;

and a third roller positioned below one of said pair of rollers and cooperable therewith to define a fold gap through which said stapled set of sheets is pulled after said leading edge of said stapled set of sheets engages said stop member and the trailing part of the stapled set of sheets continues to be pulled down between said pair of rollers;

the improvement which comprises a stapling and guide unit attached to said folder above said pair of rollers, said stapling and guide means having:

a stapling station including a power-operated stapling mechanism located above and on said one side of said pair of rollers;

guide means inclined downward and forward from said stapling station toward said pair of rollers for passing a stapled set of sheets from said stapling mechanism down to said pair of rollers;

stop means in said guide means normally positioned for engagement by the leading edge of a stack of sheets in said stapling station to hold said stack against movement down said guide means to said pair of rollers;

and means for retracting said stop means from engagement by the leading edge of said stack of sheets when said stapling mechanism stapled said stack into a stapled set of said sheets, thereby permitting said stapled set of sheets to pass down said guide means to said pair of rollers;

and means for selectively adjusting said third roller vertically to provide a corresponding gap between said third roller and said one roller of said pair of rollers.

17. In combination with a folder having:

a pair of power-driven rollers operatively arranged to pull down between them a stapled set of sheets of paper;

guide members extending down from said pair of rollers on one side thereof, said guide members defining a downwardly inclined guide recess located on said one side of said pair of rollers, said guide recess having an open upper end positioned to receive the stapled set of sheets pulled down by said pair of rollers;

a stop member positioned in said guide recess in the path of said stapled set of sheets for engagement by the leading edge of said stapled set of sheets to prevent the continued advance of said set of sheets down into said guide recess;

and a third roller positioned below one of said pair of rollers and cooperable therewith to define a fold gap through which said stapled set of sheets is pulled after said leading edge of said stapled set of sheets engages said stop member and the trailing part of the stapled set of sheets continues to be pulled down between said pair of rollers;

the improvement which comprises a stapling and guide unit attached to said folder above said pair of rollers, said stapling and guide means having:

a stapling station including a power-operated stapling mechanism located above and on said one side of said pair of rollers;

guide means inclined downward and forward from said stapling station toward said pair of rollers for passing a stapled set of sheets from said stapling mechanism down to said pair of rollers;

stop means in said guide means normally positioned for engagement by the leading edge of a stack of sheets in said stapling station to hold said stack against movement down said guide means to said pair of rollers;

means for retracting said stop means from engagement by the leading edge of said stack of sheets when said stapling mechanism staples said stack into a stapled set of said sheets, thereby permitting said stapled set of sheets to pass down said guide means to said pair of rollers;

means on said guide means providing a calibrated scale displaying the distance forward from said stapling station;

and means for adjusting said stop means along said scale toward and away from said stapling station.

18. The combination of claim 17 wherein:

said means for adjusting said stop means comprises a positioning rod extending below said guide means and elongated lengthwise of said scale, said rod having a plurality of recesses therein spaced apart along its length;

and further comprising:

a cross wall having an opening therein which passes said positioning rod;

and spring means biasing said positioning rod against an edge of said opening to releasable hold said rod in said cross wall at a selected one of recesses in the rod.

19. A method of converting a paper folder, having plates and rollers cooperating with each other, to a booklet maker which comprises the steps of removing one of said plates from the folder and replacing said plate with a feeding and stapling apparatus.

* * * * *